US007884548B2

(12) United States Patent
Yoshioka et al.

(10) Patent No.: US 7,884,548 B2
(45) Date of Patent: Feb. 8, 2011

(54) PLASMA DISPLAY PANEL

(75) Inventors: Toshihiro Yoshioka, Yamanashi (JP); Takayoshi Hirakawa, Yamanashi (JP)

(73) Assignee: Panasonic Corporation, Kadoma-shi (JP)

( * ) Notice: Subject to any disclaimer, the term of this patent is extended or adjusted under 35 U.S.C. 154(b) by 286 days.

(21) Appl. No.: 11/812,857

(22) Filed: Jun. 22, 2007

(65) Prior Publication Data

US 2008/0030137 A1 Feb. 7, 2008

(30) Foreign Application Priority Data

Aug. 7, 2006 (JP) ..... 2006-214500

(51) Int. Cl.
*H01J 17/49* (2006.01)

(52) U.S. Cl. ..... 313/587; 313/582; 313/586

(58) Field of Classification Search ..... 313/582–587
See application file for complete search history.

(56) References Cited

U.S. PATENT DOCUMENTS

| | | | | |
|---|---|---|---|---|
| 7,507,289 | B2 * | 3/2009 | Hosono et al. | 117/4 |
| 2001/0050534 | A1 * | 12/2001 | Amemiya et al. | 313/586 |
| 2006/0055325 | A1 * | 3/2006 | Hirota et al. | 313/587 |

FOREIGN PATENT DOCUMENTS

| | | | |
|---|---|---|---|
| EP | 1 580 786 A2 | 9/2005 | |
| EP | 1 580 786 A3 | 10/2007 | |
| JP | 2006-059780 A | 3/2006 | |
| WO | WO 2005/000741 A1 * | 6/2005 | |

OTHER PUBLICATIONS

Boeuf J.P. et al.; "Physics of a PDP discharge cell-improvement of luminance and luminous efficiency"; vol. 1; Oct. 12, 2003; pp. 69-73; XP010675963.

Matsuishi S. et al.; "High-density electron anions in a nanoporous single crystal"; vol. 301; Aug. 1, 2003; pp. 626-629; XP002979506.

Choi H-N. et al.; "Characteristics of 12Ca07A1$_2$0$_3$ electride as electron emission layer for PDP"; vol. 2; Jul. 1, 2006; pp. 836-837; XP009118017.

Jong-Hyun Park et al.; "32.3 Distinguished Student Paper: High Efficiency Hybrid PDP"; vol. XXXVI; May 24, 2005; pp. 1240-1243; XP007012276.

* cited by examiner

*Primary Examiner*—Bumsuk Won
(74) *Attorney, Agent, or Firm*—Arent Fox LLP

(57) ABSTRACT

A PDP comprises: front and back glass substrates facing each other across a discharge space; a plurality of row electrode pairs and column electrodes disposed between the front and back glass substrates and extending in directions at right angles to each other to form discharge cells in positions corresponding to the intersections in the discharge space; and an electride compound in which electrons are substituted for part of anions in the crystal lattice and which is disposed in an area facing the discharge cells and exposed to each discharge cell.

17 Claims, 6 Drawing Sheets

MODIFIED EXAMPLE

FIRST EMBODIMENT

SECTION II-II

MODIFIED EXAMPLE

MODIFIED EXAMPLE

MODIFIED EXAMPLE

SECOND EMBODIMENT

THIRD EMBODIMENT

MODIFIED EXAMPLE

MODIFIED EXAMPLE

MODIFIED EXAMPLE

MODIFIED EXAMPLE

PLASMA DISPLAY PANEL

BACKGROUND OF THE INVENTION

1. Field of the Invention

This invention relates to the structure of plasma display panels.

The present application claims priority from Japanese Application No. 2006-214500, the disclosure of which is incorporated herein by reference.

2. Description of the Related Art

In some conventional surface-discharge type AC plasma display panels (hereinafter referred to as "a PDP"), a protective layer is provided on a dielectric layer overlying row electrode pairs arranged on the inner face of the front glass substrate. The protective layer comprises a lamination of a thin-film magnesium oxide layer deposited by vapor deposition or by sputtering, and a crystalline magnesium oxide layer including a magnesium oxide single-crystal produced by a vapor-phase oxidization technique.

Examples of such conventional PDPs include one disclosed in Japanese Unexamined Patent Publication 2006-59780.

The conventional PDP can exhibit excellent discharge characteristics because the crystalline magnesium oxide layer forming part of the protective layer for the dielectric layer includes magnesium oxide single-crystal produced by a vapor-phase oxidization technique so as to offer an improvement in discharge characteristics, such as a reduction in discharge delay and an increase in the discharge probability in the PDP.

However, in such conventional PDPs, the protective layer on the dielectric layer is formed of MgO which is alkaline earth oxides, and thus cannot adequately fulfill the function as the electron emission layer. In particular, when the protective layer is provided in a PDP with the discharge space filled with a discharge gas with a high xenon partial pressure, the PDP cannot adequately benefit from the effects of reducing the discharge voltage and improving the luminous efficiency.

As recent improvements in the high resolution of the PDP are increasing the number of display lines, a greater improvement in the discharge characteristics such as a reduction in power consumption and an increase in the luminous efficiency is strongly desired.

SUMMARY OF THE INVENTION

It is an object of the present invention to provide a PDP capable of overcoming the disadvantages associated with the conventional PDPs as described above.

To attain this object, in a best mode for carrying out a plasma display panel according to the present invention, a PDP comprises a front substrate and a back substrate which face each other across a discharge space; a plurality of row electrode pairs and column electrodes which are disposed between the front substrate and the back substrate and extend in directions at right angles to each other to form unit light emission areas in positions corresponding to the intersections in the discharge space; and an electride compound in which electrons are substituted for part of anions in the crystal lattice and which is disposed in an area facing the unit light emission areas between the front substrate and the back substrate and is exposed to each of the unit light emission areas.

The PDP according to this mode uses the row electrode pairs and the column electrode to initiate a reset discharge, an address discharge and a sustaining discharge in the unit light emission areas for generation of a matrix-display image. In each of these discharges, the electride compound provided on portions of the front substrate and the back substrate facing the unit light emission areas emits electrons into the unit light emission areas.

Thus, the discharge voltage for each discharge in the PDP is reduced and the discharge delay is improved, resulting in an further improvement in luminous efficiency.

In addition, even when the discharge gas filling the discharge space includes 10% or more xenon by volume, the satisfactory effects of reducing the discharge voltage and of improving the luminous efficiency can be achieved.

The PDP according the above mode can adopt some ways to dispose the electride compound in the area facing the unit light emission areas: the electride compound may be mixed into a protective layer overlying a unit-light-emission-area-facing face of a dielectric layer covering the row electrode pairs, or alternatively into phosphor layers facing the unit light emission areas. Alternatively, a protective layer covering a dielectric layer may be designed to have a multilayer structure and a layer of the multilayer-structure protective layer facing the unit light emission areas is formed of the electride compound to form an electron emission layer. Yet alternatively, the electride compound may be provided in both the protective layer and the phosphor layers.

In examples of another way to dispose the electride compound in an area facing the unit light emission areas, the electride compound may be provided in a bar-shaped area extending in a direction parallel to the direction in which the row electrode pairs extend and facing portions of the row electrode pairs provided for initiating a discharge. The electride compound may be disposed in island-form areas separated from each other in the respective unit light emission areas and each facing a portion of each of the row electrode pairs provided for initiating a discharge. When the electride compound is disposed in the area in which the discharge is initiated in the PDP, this makes it possible to effectively achieve a reduction in discharge voltage and an improvement in luminous efficiency.

When the protective layer or a layer of the multilayer-structure protective layer other than the electron emission layer is formed of magnesium oxide, the electron emission function performed by the magnesium oxide can be available in addition to the electron emission function performed by the electride compound.

Examples of the electride compound include a compound having a composition expressed by $12CaO.7Al_2O_3$.

Regarding a preferable electride compound used in the PDP according to the present invention, electrons are substituted for part of anions in the crystal lattice close to the crystal surface, or alternatively, the electride compound has a low density of cages, in which electrons are clathrated, in the crystal.

If all the anions in the entire crystal are replaced with electrons or if the density of cages where electrons are clathrated is high, the electride compound becomes opaque. As a result, when such an electride compound is used on the front substrate, the electride compound causes a reduction in light transmittance, which in turn causes a reduction in panel luminance. When the electride compound is mixed into the phosphor layer, the electride compound may possibly cause a reduction in the rate of light emission from the phosphor layer. However, the use of the electride compound, in which electrons are substituted for part of anions in the crystal lattice close to the crystal surface or which has a low density of cages, in which electrons are clathrated, in the crystal, makes it possible to successfully realize the electron emission into the unit light emission areas so as to offer a reduction in discharge voltage in the PDP and an improvement in luminous efficiency without a reduction in panel luminance and the rate of light emission.

In the PDP according to the present invention, magnesium oxide crystal disposed, together with the electride compound, is preferably provided in the area facing the unit light emission areas between the front substrate and the back substrate. In this case, the magnesium oxide crystal has characteristics that cause a cathode-luminescence emission having a peak within a wavelength range of 200 nm to 300 nm upon excitation by an electron beam.

By this design, as well as the reduction of the discharge voltage, the improvement of the discharge delay and the improvement of the luminous efficiency which are yielded by the electride compound, the improvement of discharge characteristics of the PDP about discharge delay and the like which are yielded by the MgO crystal can be further promoted.

In this case, a preferable MgO crystal has a particle diameter of 2000 or more angstroms, is produced by a vapor phase oxidation technique, or the like.

These and other objects and features of the present invention will become more apparent from the following detailed description with reference to the accompanying drawings.

DETAILED DESCRIPTION OF THE PREFERRED EMBODIMENTS

First Embodiment

Figure 1:
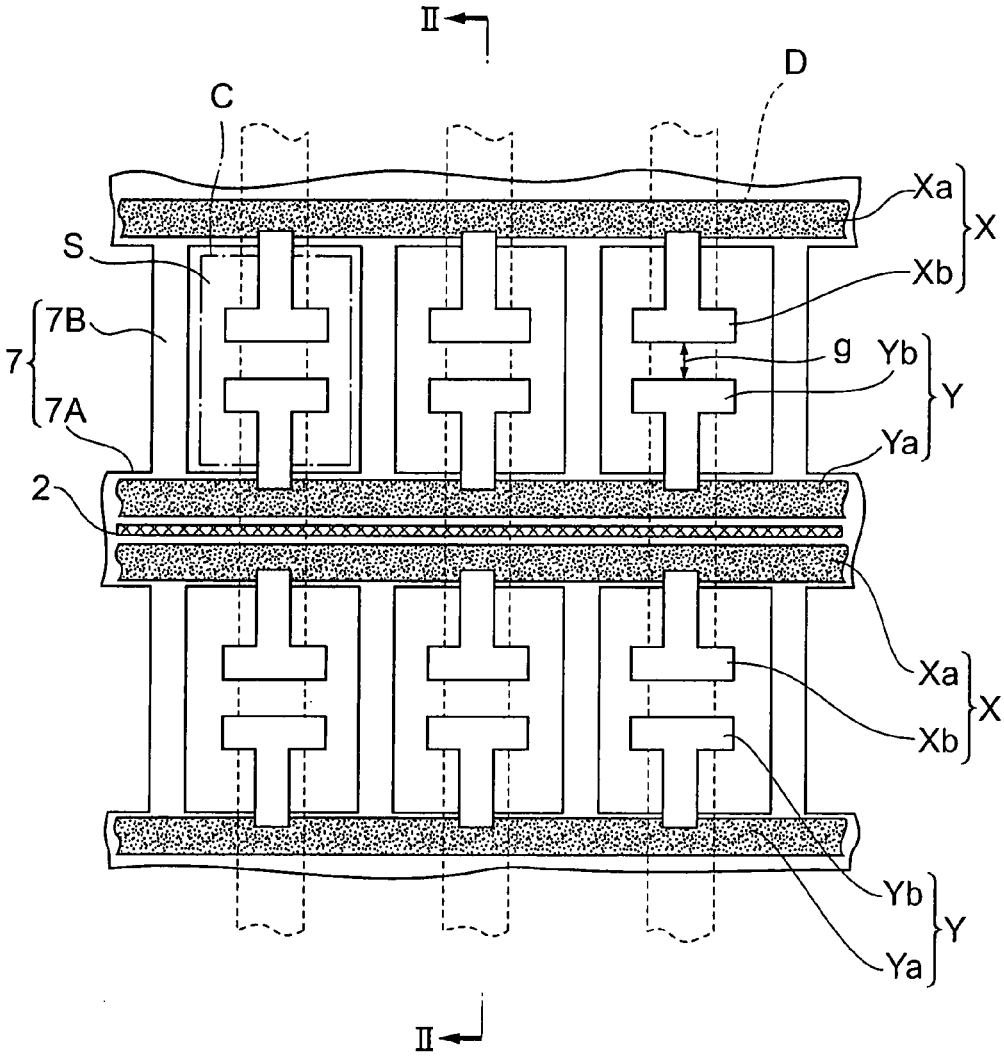
FIG. 1 is a front view illustrating a first embodiment according to the present invention.
Figure 2:
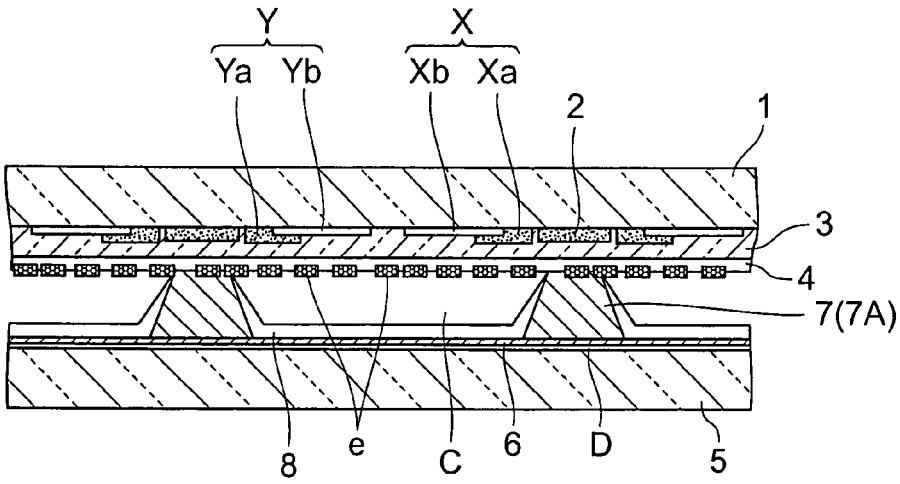
FIG. 2 is a sectional view taken along the II-II line in FIG. 1.

FIGS. 1 and 2 illustrate a first embodiment of a surface-discharge type AC PDP according to the present invention. FIG. 1 is a schematic front view of the PDP in the first embodiment. FIG. 2 is a sectional view taken along the II-II line in FIG. 1.

The PDP in FIGS. 1 and 2 has a plurality of row electrode pairs (X, Y) each extending in the row direction (the right-left direction in FIG. 1) and regularly arranged parallel to each other in the column direction (the vertical direction in FIG. 1) on the rear-facing face (the face facing the rear of the PDP) of a front glass substrate 1 serving as the display surface.

A row electrode X and a row electrode Y which constitute each row electrode pair (X, Y) are each composed of a bus electrode Xa, Ya formed of a belt-shaped black metal film extending in the row direction, and a plurality of transparent electrodes Xb, Yb which are arranged along the bus electrode Xa, Ya at regular intervals and connected at their proximal ends to the bus electrode Xa, Ya. In each row electrode pair (X, Y), the paired transparent electrodes Xb and Yb face each other across a discharge gap g.

Black- or dark-colored light absorption layers 2 are formed on the rear-facing face of the front glass substrate 1. Each of the light absorption layers 2 extends in the row direction between the back-to-back bus electrodes Xa and Ya of the adjacent row electrode pairs (X, Y) arranged in the column direction.

In addition, a dielectric layer 3 is formed on the rear-facing face of the front glass substrate 1 so as to overlie the row electrode pairs (X, Y) and the light absorption layers 2.

A protective layer 4 is in turn formed on the rear-facing face of the dielectric layer 3 so as to overlie the dielectric layer 3.

The structure of the protective layer 4 will be described later in detail.

The front glass substrate 1 is placed parallel to a back glass substrate 5 across the discharge space S. Column electrodes D are arranged parallel to each other at predetermined intervals in the row direction on the front-facing face (the face facing toward the display surface of the PDP) of the back glass substrate 5. Each of the column electrodes D extends in a direction at right angles to the row electrode pairs (X, Y) (i.e. in the column direction) on a portion of the back glass substrate 5 opposite to the paired transparent electrodes Xb and Yb of each row electrode pair (X, Y).

On the front-facing face of the back glass substrate 5, a column-electrode protective layer (dielectric layer) 6 overlies the column electrodes D, and in turn a partition wall unit 7 is formed on the column-electrode protective layer 6.

The partition wall unit 7 is formed in an approximate grid shape made up of a plurality of transverse walls 7A and a plurality of vertical walls 7B. Each of the transverse walls 7A which extend in the row direction faces the bus electrodes Xa and Ya of the respective back-to-back row electrodes X and Y of the adjacent row electrode pairs (X, Y) and the light absorption layer 2 situated between the bus electrodes Xa and Ya. Each of the vertical walls 7B which extend in the column direction is positioned corresponding to in the mid-position between the adjacent column electrodes D arranged on the back glass substrate 5.

The approximately grid-shaped partition wall unit 7 partitions the discharge space S defined between the front glass substrate 1 and the back glass substrate 5 into areas to form discharge cells C in positions each corresponding to the paired transparent electrodes Xb and Yb of each row electrode pair (X, Y).

A phosphor layer 8 overlies the five faces facing each discharge cell C: the four side faces of the transverse walls 7A and the vertical walls 7B of the partition wall unit 7 and the face of the column-electrode protective layer 6. The colors of the phosphor layers 8 in the respective discharge cells C are arranged such that the three primary colors, red, green and blue, are arranged in order in the row direction one to each discharge cell C.

The discharge space S is filled with discharge gas including 10% or more xenon by volume.

The aforementioned protective layer 4 comprises a thin-film or thick-film MgO layer mixed with an electride compound in which electrons are substituted for part of anions in the crystal lattice, for example, a powder of an electride compound e in which electrons are clathrated in cages (hereinafter referred to as "electron cages") in the crystal structure, such as $12CaO.7Al_2O_3$ or the like.

The electride compound e is included in the MgO layer such that at least part of the electride compound e is located close to the surface of the MgO layer in such a manner as to be exposed to the discharge space S (discharge cell C).

The PDP initiates a reset discharge simultaneously between the row electrodes X and Y of each row electrode pair (X, Y) or between each row electrode Y and each column electrode D for initialization of all the discharge cells C. Then, the PDP initiates an address discharge selectively between the row electrode Y and the column electrode D. As a result, the light-emitting cells having the deposition of the wall charge on a portion of the dielectric layer 3 facing the discharge cell C and the non-light-emitting cells in which the wall charge has been erased from the dielectric layer are distributed over the panel surface in response to the video signal. Then, a sustaining discharge is initiated across the discharge gap g between the paired transparent electrodes Xb and Yb of the row electrodes X and Y in each of the light-emitting cells. The sustaining discharge excites the xenon included in the discharge gas filling the discharge cell C. As a result, vacuum ultraviolet light is generated, which then causes the red, green and blue phosphor layers 8 to emit visible light to generate a matrix display image.

When each of the above discharges is initiated in the discharge cell C, the protective layer 4 functions as an electron emission layer, so that electrons are emitted into the discharge cell C from the electride compound e, because the electride compound e is located on a portion of the surface of the protective layer 4 facing the discharge cell C.

Even when the discharge gas includes 10% or higher of xenon by volume, the electron emission from the electride compound e of the protective layer 4 leads to a reduction in discharge voltage of the PDP including a breakdown voltage for each discharge, and a reduction in the electric field in a cathode fall region in either the row electrode X or Y serving as a cathode, thus increasing the efficiency of ultraviolet-light excitation, resulting in an improvement in the luminous efficiency of the PDP.

In the PDP, the electride compound e included in the MgO layer of the protective layer 4 desirably has electron cages in which electrons are substituted for anions, located only in the portion close to the crystal surface.

The reason for this is described. If the electron cages exist in the entire crystal of the electride compound e which has a certain thickness, the crystal of the electride compound e becomes metallic, that is, becomes opaque, resulting in a reduction in light transmittance. This means that the visible light generated from the phosphor layer 8 has difficulty in passing through the protective layer 4, which in turn causes a reduction in panel luminance.

As described above, because the electride compound e, in which electron cages exist only close to the crystal surface, is mixed into the MgO layer, a reduction in the discharge voltage and an improvement in the luminous efficiency, which are yield by the electride compound e, can be achieved without a reduction in the panel luminance.

Alternatively, in order for the PDP to use the electride compound e to achieve a reduction in the discharge voltage and an improvement in the luminous efficiency without a reduction in the panel luminance, an electride compound e having a low density of electron cages in the crystal may be mixed into the MgO layer.

Figure 3:
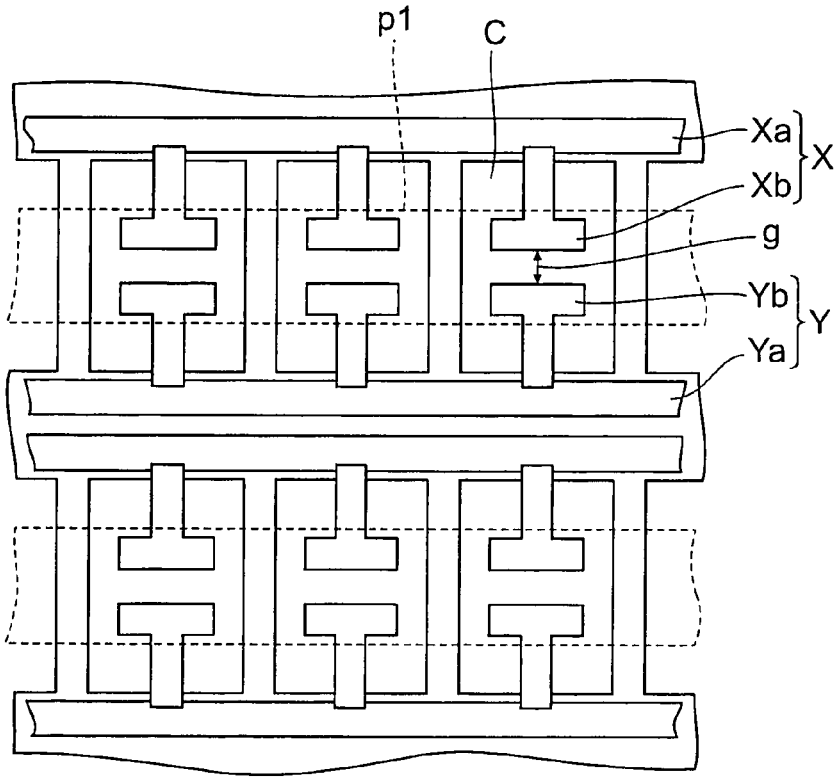
FIG. 3 is a front view illustrating a modified example of the first embodiment.
Figure 4:
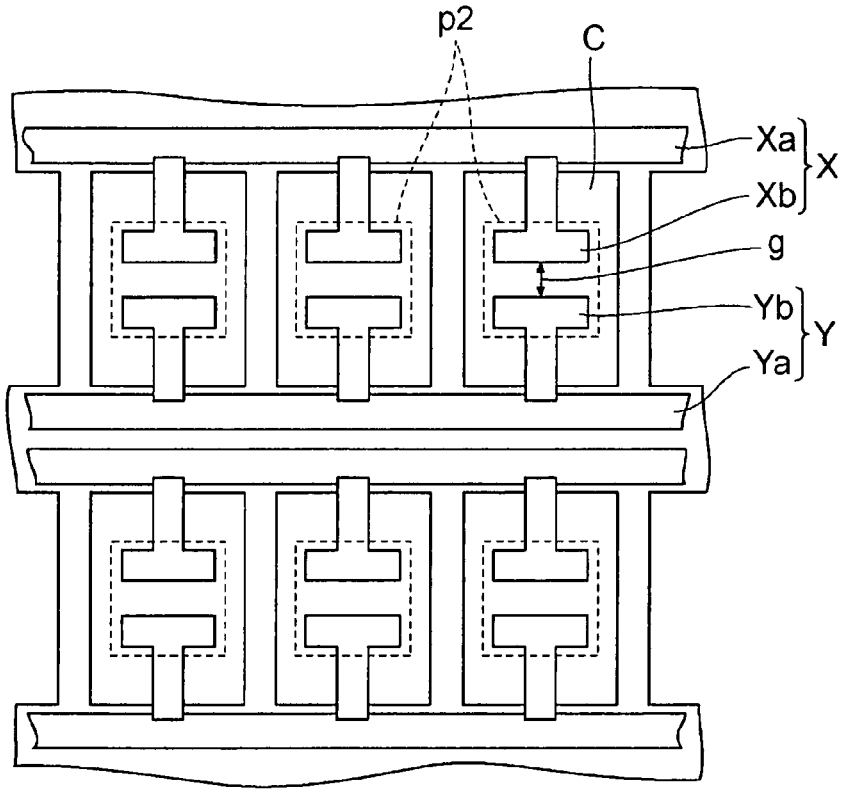
FIG. 4 is a front view illustrating another modified example of the first embodiment.

In the PDP, the method of mixing the electride compound e is not limited to the foregoing mixing of the electride compound e into the MgO layer over the full area of the protective layer 4. For example, as illustrated in FIG. 3, the electride compound e may be mixed into the MgO layer such that the electride compound e is disposed in only bar-shaped portions p1 of the protective layer 4. In this case, each of the bar-shaped portions p1 extends in the row direction and is positioned opposite the discharge gaps g and the leading ends of the transparent electrodes Xb and Yb facing each other across the discharge gaps g. Alternatively, as shown in FIG. 4, the electride compound e may be mixed into the MgO layer such that the electride compound e is disposed in only island-shaped quadrangular portions p2 of the MgO layer. In this case, each of the island-shaped quadrangular portions p2 is positioned in each discharge cell C and opposite the discharge gap g and the two leading ends of the transparent electrodes Xb and Yb facing each other across this discharge gap g.

Figure 5:
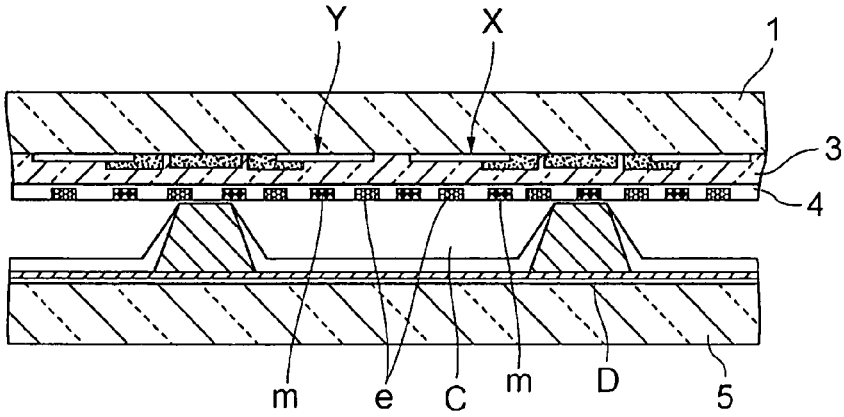
FIG. 5 is a sectional view illustrating yet another modified example of the first embodiment.

In the foregoing PDP, as illustrated in FIG. 5, the MgO layer of the protective layer 4 may be mixed with MgO crystal m, e.g., MgO crystal obtained by a vapor phase technique, having characteristics that cause a cathode-luminescence emission having a peak within a wavelength range of 200 nm to 300 nm upon excitation by an electron beam, as well as the electride compound e.

The MgO crystal m preferably has a particle diameter of 2000 or more angstroms.

By mixing the MgO crystal, an improvement in discharge characteristics about discharge probability, discharge delay and the like is achieved by the effects of the MgO crystal m, in addition to the reduction in discharge voltage and the improvement in luminous efficiency which are achieved by the effects of the electride compound e.

Second Embodiment

Figure 6:
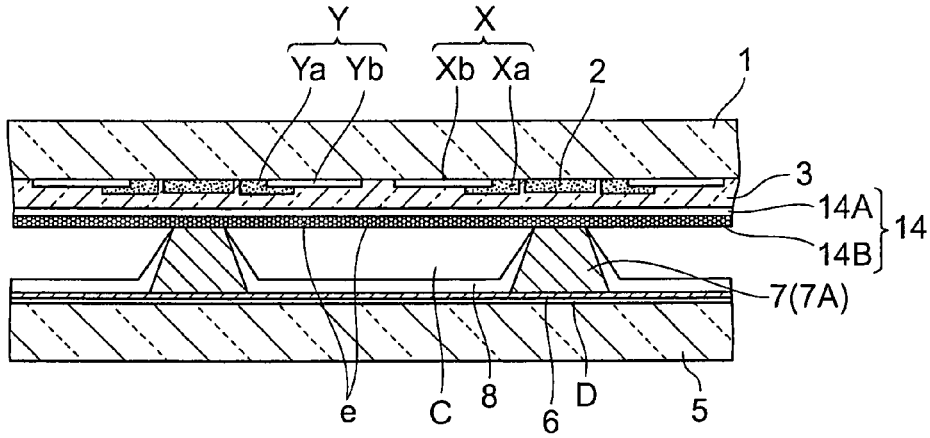
FIG. 6 is a sectional view illustrating a second embodiment according to the present invention.

FIG. 6 illustrates a second embodiment of a surface-discharge-type alternating-current PDP according to the present invention.

In the aforementioned PDP of the first embodiment, the electride compound is mixed into the MgO layer forming part of the protective layer. In the PDP of the second embodiment, a protective layer has a double layer structure made up of an MgO layer and an electron emission layer formed of an electride compound.

Specifically, in FIG. 6, a thin-film MgO layer 14A is deposited on the rear-facing face of the dielectric layer 3, and then an electron emission layer 14B is deposited on the MgO layer 14A to form a lamination. The electron emission layer 14B is formed of an electride compound e such as $12CaO.7Al_2O_3$ or the like in which electrons are substituted for part of anions in the crystal lattice. The two layers, the MgO layer 14A and the electron emission layer 14B, form a protective layer 14. The electron emission layer 14B is situated facing the discharge cell C, so that the electride compound e is exposed to the discharge cell C.

The structure of other components of the PDP is the same as that in the first embodiment, and the same components are designated by the same reference numerals in FIG. 6 as those in FIG. 2.

The electride compound e used in the second embodiment is identical in composition and characteristics with that used in the first embodiment. The electride compound e is exposed to the discharge cell C by arranging the electron emission layer 14B in a position facing the discharge cell C. As a result, electron emission from the electride compound e offers a reduction in the discharge voltage of the PDP including firing voltage for each discharge, and also a reduction in the electric field in a cathode fall region in either the row electrode X or Y serving as a cathode, thus increasing the efficiency of ultraviolet-light excitation, resulting in an improvement in the luminous efficiency of the PDP.

In the PDP of the second embodiment, as in the case of the first embodiment, the electron emission layer 14B is preferably formed of an electride compound e in which electron cages exist only in a position close to the crystal surface, or alternatively of an electride compound e having a low density of electron cages in crystal, in order to prevent a reduction in the light transmittance of the protective layer 14.

In the PDP, the position where the electron emission layer 14B formed of the electride compound e is formed is not limited to the foregoing position over the full area of the Mgo layer 14A. For example, as in the case of the examples described in FIGS. 3 and 4 in the first embodiment, the electron emission layer 14B may be formed on a bar-shaped portion of the MgO layer 14A which extends in the row direction and is positioned opposite the discharge gaps g and the leading ends of the transparent electrodes Xb and Yb facing each other across the discharge gaps g, or alternatively, may be formed on an island-shaped quadrangular portion of the MgO layer 14A which is positioned in each discharge cell C and opposite the discharge gap g and the two leading ends of the transparent electrodes Xb and Yb facing each other across this discharge gap g.

In the foregoing PDP, the electron emission layer 14B may be mixed with MgO crystal m, e.g., MgO crystal obtained by a vapor phase technique, having characteristics that cause a cathode-luminescence emission having a peak within a wavelength range of 200 nm to 300 nm upon excitation by an electron beam, in order to achieve an improvement in discharge characteristics about discharge probability, discharge delay and the like in addition to the reduction of discharge voltage and the improvement of luminous efficiency which are yielded by the electride compound e.

Third Embodiment

Figure 7:
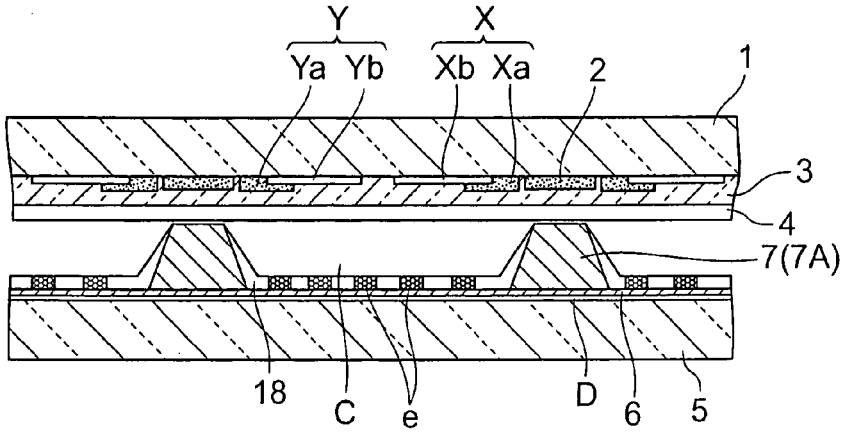
FIG. 7 is a sectional view illustrating a third embodiment according to the present invention.

FIG. 7 illustrates a third embodiment of a surface-discharge-type alternating-current PDP according to the present invention.

In the aforementioned PDP of the first and second embodiments, the electride compound is disposed on the front glass substrate. In the PDP of the third embodiment, the electride compound is mixed into the phosphor layer and disposed on the back glass substrate.

Specifically, in FIG. 7, an electride compound in which electrons are substituted for part of anions in the crystal lattice, for example, an electride compound e such as $12CaO.7Al_2O_3$ or the like, is mixed into the phosphor layer 18 which is formed on the column-electrode protective layer 6 in each discharge cell C, such that at least a part of the electride compound e is located close to the surface of the phosphor layer 18 in such a manner as to be exposed to the discharge space S (discharge cell C).

The protective layer 4 in the third embodiment is formed of only MgO. The structure of other components of the PDP of the third embodiment is the same as that in the first embodiment, and the same components are designated by the same reference numerals in FIG. 7 as those in FIG. 2.

The electride compound e used in the third embodiment is identical in composition and characteristics with that used in the first embodiment. The electride compound e is exposed to the discharge cell C, whereby electron emission from the electride compound e offers a reduction in the discharge voltage including firing voltage of the PDP.

In the PDP of the third embodiment, in order to prevent the electride compound e from becoming opaque so as to reduce the rate of light emission from the phosphor layer 18, the phosphor layer 18 is preferably mixed with an electride compound e in which electron cages exist only close to the crystal surface, or alternatively an electride compound e having a low density of electron cages in crystal.

Figure 8:
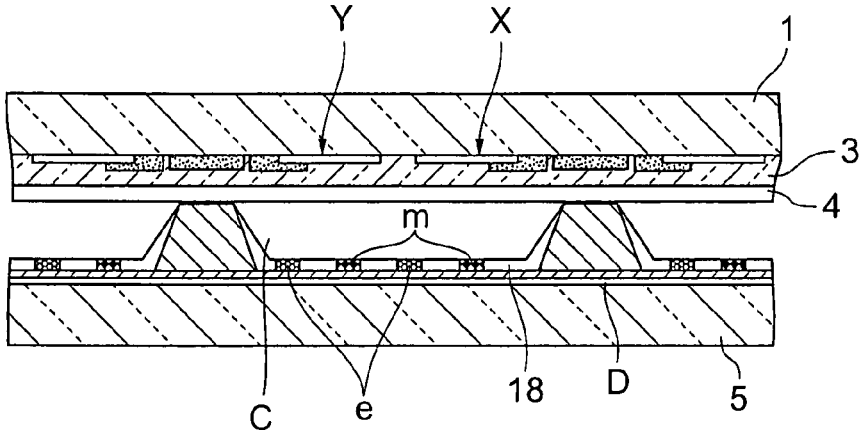
FIG. 8 is a sectional view illustrating a modified example of the third embodiment.

In the PDP, as illustrated in FIG. 8, the phosphor layer 18 may be mixed with MgO crystal m, e.g., MgO crystal obtained by a vapor phase technique, having characteristics that cause a cathode-luminescence emission having a peak within a wavelength range of 200 nm to 300 nm upon excitation by an electron beam, in order to achieve an improvement in discharge characteristics about discharge probability, discharge delay and the like in addition to the reduction of discharge voltage and the improvement of luminous efficiency which are yielded by the electride compound e.

The third embodiment has described the example of the electride compound e mixed into only the phosphor layer 18, but the third embodiment can be combined with the first or second embodiment so that the electride compound e may be disposed on both the front glass substrate 1 and the back glass substrate 5.

Figure 9:
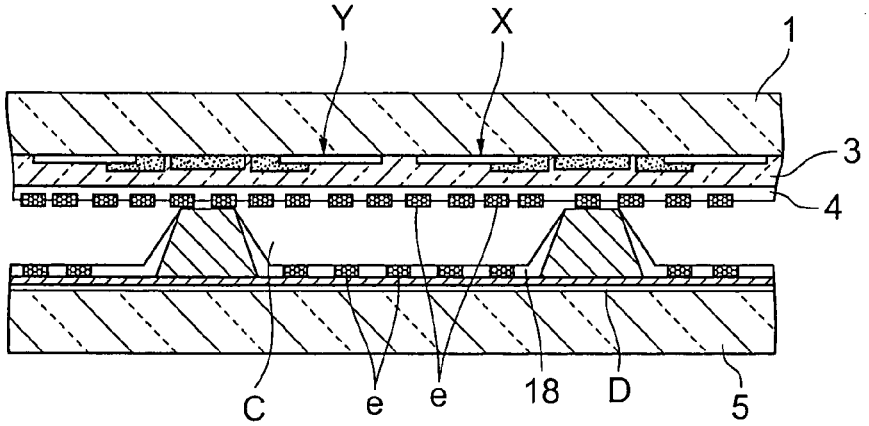
FIG. 9 is a sectional view illustrating another modified example of the third embodiment.
Figure 10:
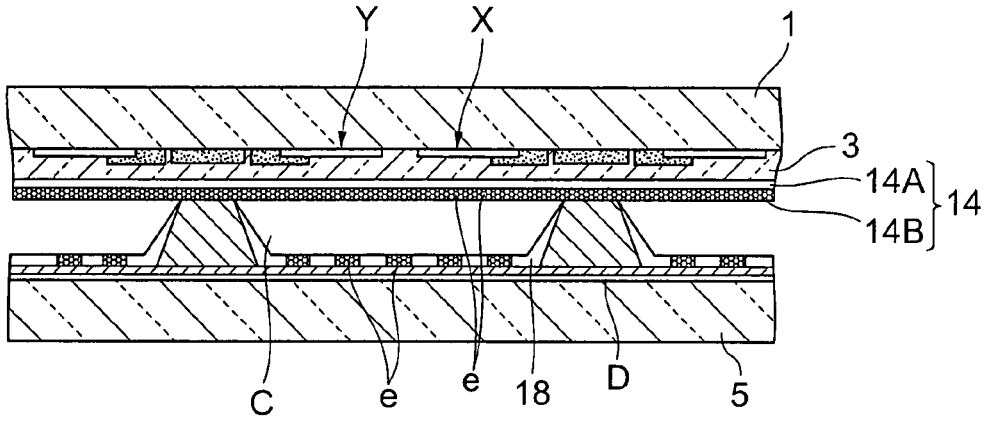
FIG. 10 is a sectional view illustrating yet another modified example of the third embodiment.
Figure 11:
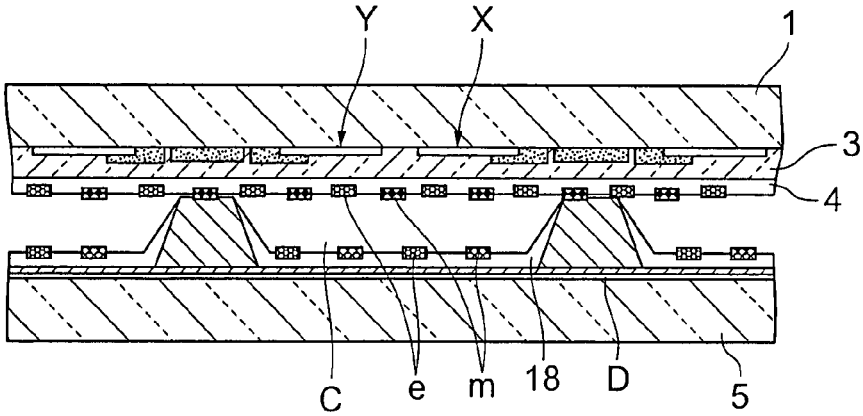
FIG. 11 is a sectional view illustrating yet another modified example of the third embodiment.

FIG. 9 illustrates an example of the combination of the first embodiment and the third embodiment, in which the electride e is mixed into both the phosphor layer 18 and the protective layer 4. FIG. 10 illustrates an example of the combination of the second embodiment and the third embodiment, in which the electride e is mixed into the phosphor layer 18 and the protective layer 14 has a double layer structure made up of the MgO layer 14A and the electron emission layer 14B formed of an electride compound e. FIG. 11 illustrates an example when the electride compound e and the MgO crystal m are mixed into both the phosphor layer 18 and the protective layer 4. Other than those above, various ways for providing an electride compound are possible.

According to the above examples, as well as the reduction of the discharge voltage and the improvement of luminous efficiency which are yielded by the electride compound e, the improvement of discharge characteristics about discharge probability, discharge delay and the like which are yielded by the MgO crystal m is further promoted.

In the foregoing, the electride compound is provided either in or on the protective layer. However, a PDP can be designed such that the protective layer is not provided and the electride compound is provided directly on the dielectric layer covering the row electrodes.

In this case, not only a method of depositing the powder of electride compound onto the dielectric layer, but also a method of using a vapor depositing technique or a sputtering technique to process an electride compound into a thin film form or a method of using a screen printing technique or an offset printing technique to process an electride compound into a thick film form can be employed.

Likewise, when the electride compound is provided on the protective layer, instead of a method of depositing the powder of electride compound onto the protective layer, a method of using a vapor depositing technique or a sputtering technique to process an electride compound into a thin film form or a method of using a screen printing technique or an offset printing technique to process an electride compound into a thick film form may be employed.

The electride compound may be formed in an area facing the electrodes and facing an area other than the electrodes, or alternatively formed in only an area which does not face the electrodes, by a patterning technique.

The electride compound thus formed by a patterning technique can be suitably created in a required shape, for example, not only in a bar shape or a quadrangular shape, but also a circular shape, an oval shape or a meandering shape.

The PDP described in each of the aforementioned embodiments is based on a basic idea that a PDP comprises a front substrate and a back substrate which face each other across a discharge space, a plurality of row electrode pairs and of column electrodes which are disposed between the front substrate and the back substrate and extend in directions at right angles to each other so as to form unit light emission areas in positions corresponding to the intersections of the row electrode pairs and the column electrodes in the discharge space, and an electride compound, in which electrons are substituted for part of anions in the crystal lattice, disposed in an area facing the unit light emission areas between the front substrate and the back substrate and is exposed to each of the unit light emission areas.

The PDP based on this basic idea use the row electrode pairs and the column electrode to initiate a reset discharge, an address discharge and a sustaining discharge in the unit light emission areas for generation of a matrix-display image. In each of the discharges, the electride compound provided on portions of the front substrate and the back substrate facing the unit light emission areas emits electrons into the unit light emission areas.

Thus, the discharge voltage for each discharge in the PDP is reduced and the luminous efficiency is improved. In addition, even when the discharge gas filling the discharge space includes 10% or more xenon by volume, the satisfactory effects of reducing the discharge voltage and of improving the luminous efficiency can be achieved.

The terms and description used herein are set forth by way of illustration only and are not meant as limitations. Those skilled in the art will recognize that numerous variations are possible within the spirit and scope of the invention as defined in the following claims.

What is claimed is:

1. A plasma display panel comprising:

a front substrate and a back substrate which face each other across a discharge space;

a plurality of row electrode pairs and column electrodes which are disposed between the front substrate and the back substrate and extend in directions at right angles to each other to form unit light emission areas in positions corresponding to the intersections in the discharge space; and an electride compound in which electrons are substituted for only part of anions in the crystal lattice and which is disposed in an area facing the unit light emission areas between the front substrate and the back substrate and is exposed to each of the unit light emission areas, wherein, in the electride compound, electrons are substituted for only part of anions in the crystal lattice close to the crystal surface.

2. A plasma display panel according to claim 1, wherein the row electrode pairs, a dielectric layer covering the row electrode pairs, and a protective layer overlying a face of the dielectric layer facing the unit light emission areas are formed on the front substrate, and the electride compound is mixed into the protective layer.

3. A plasma display panel according to claim 2, wherein the protective layer is formed of magnesium oxide.

4. A plasma display panel according to claim 2, wherein the electride compound is disposed in a required partial area of the protective layer.

5. A plasma display panel according to claim4, wherein the electride compound is mixed into a bar-shaped portion of the protective layer extending in a direction parallel to the direction in which the row electrode pairs extend and facing portions of the row electrode pairs provided for initiating a discharge.

6. A plasma display panel according to claim 5, wherein the electron emission layer faces a portion of each of the row electrode pairs provided for initiating a discharge and is formed independently in an island shape for each unit light emission area.

7. A plasma display panel according to claim 4, wherein the electride compound is mixed into island-form portions of the protective layer separated from each other in the respective unit light emission areas and each facing a portion of each of the row electrode pairs provided for initiating a discharge.

8. A plasma display panel according to claim 1, wherein the row electrode pairs, a dielectric layer covering the row electrode pairs, and a protective layer overlying a face of the dielectric layer facing the unit light emission areas are formed on the front substrate, and the protective layer has a magnesium oxide layer formed on the dielectric layer and an electron emission layer laminated on the magnesium oxide layer and facing the unit light emission areas, and the electron emission layer is formed of the electride compound.

9. A plasma display panel according to claim 8, wherein the electron emission layer is disposed in a required partial area on the protective layer.

10. A plasma display panel according to claim 9, wherein the electron emission layer faces portions of the row electrode pairs provided for initiating a discharge and is formed in a bar shape extending in a direction parallel to the direction in which the row electrode pairs extend.

11. A plasma display panel according to claim 1, wherein the column electrodes and phosphor layers facing the unit light emission areas are formed on the back substrate, and the electride compound is mixed into the phosphor layers.

12. A plasma display panel according to claim 1, wherein the row electrode pairs, a dielectric layer covering the row electrode pairs, and a protective layer overlying a face of the dielectric layer facing the unit light emission areas are formed on the front substrate, and the column electrodes and phosphor layers facing the unit light emission areas are formed on the back substrate, and the electride compound is mixed into the protective layer and the phosphor layers.

13. A plasma display panel according to claim 1, wherein the electride compound includes a compound having a composition expressed by $12CaO\ 7Al_2O_3$.

14. A plasma display panel according to claim 1, further comprising magnesium oxide crystal disposed, together with the electride component, in an area facing the unit light emission areas between the front substrate and the back substrate, the magnesium oxide crystal having characteristics that cause a cathode-luminescence emission having a peak within a wavelength range of 200 nm to 300 nm upon excitation by an electron beam.

15. A plasma display panel according to claim 14, wherein the magnesium oxide crystal has a particle diameter of 2000 or more angstroms.

16. A plasma display panel according to claim 14, wherein the magnesium oxide crystal is magnesium oxide single-crystal produced by a vapor phase oxidation technique.

17. A plasma display panel according to claim 1, wherein the discharge space is filled with a discharge gas including 10% or more of xenon by volume.

* * * * *